US011062557B2

(12) United States Patent
Pace

(10) Patent No.: US 11,062,557 B2
(45) Date of Patent: Jul. 13, 2021

(54) SECURITY METHOD AND SYSTEM FOR ELECTRONIC GAME VIRTUAL REFILL CARTRIDGE

(71) Applicant: Savvy Dog Systems, LLC, Alpharetta, GA (US)

(72) Inventor: Michael R. Pace, Alpharetta, GA (US)

(73) Assignee: Savvy Dog Systems, LLC, Duluth, GA (US)

( * ) Notice: Subject to any disclaimer, the term of this patent is extended or adjusted under 35 U.S.C. 154(b) by 69 days.

(21) Appl. No.: 16/272,307

(22) Filed: Feb. 11, 2019

(65) Prior Publication Data

US 2019/0206186 A1 Jul. 4, 2019

Related U.S. Application Data

(63) Continuation of application No. 15/357,755, filed on Nov. 21, 2016, now Pat. No. 10,204,482, which is a (Continued)

(51) Int. Cl.
*G07F 17/32* (2006.01)

(52) U.S. Cl.
CPC ..... *G07F 17/3241* (2013.01); *G07F 17/32* (2013.01); *G07F 17/3227* (2013.01); (Continued)

(58) Field of Classification Search
CPC .. G07F 17/3244; G07F 17/32; G07F 17/3241; G07F 17/3227; G07F 17/3255; G07F 17/3295
See application file for complete search history.

(56) References Cited

U.S. PATENT DOCUMENTS 5,482,289 A 1/1996 Weingardt
6,089,977 A 7/2000 Bennett
(Continued)

FOREIGN PATENT DOCUMENTS

EP 0449433 A2 10/1991
GB 2251112 A 6/1992
GB 2382911 A 6/2003

OTHER PUBLICATIONS

Turner, "Tic-Tac-Fruit: An Analysis, " Nov. 15, 2004.
(Continued)

*Primary Examiner* — Steve Rowland
(74) *Attorney, Agent, or Firm* — Womble Bond Dickinson (US) LLP

(57) ABSTRACT

According to aspects of this disclosure, a method, system, and program product for controlling the operation and configuration of an electronic game terminal can be provided. A game operator can be enabled to select a series of play levels that can be selected by a user for play of at least one electronic game on the electronic game terminal. The at least one electronic game can include a plurality of play levels that can be selected by a player. Further, a field can be constructed that has a plurality of elements for a game display by an electronic game processor, and each element can be filled by a game symbol from a plurality of available game symbols. The game symbols for each element can be automatically determined for each play of the game such that there is no winning combination without player interaction. Other aspects also are described.

10 Claims, 14 Drawing Sheets

Related U.S. Application Data continuation of application No. 14/584,430, filed on Dec. 29, 2014, now Pat. No. 9,501,896, which is a continuation of application No. 11/694,283, filed on Mar. 30, 2007, now Pat. No. 8,920,231.

(60) Provisional application No. 60/788,363, filed on Mar. 31, 2006.

(52) U.S. Cl.
CPC ..... *G07F 17/3244* (2013.01); *G07F 17/3255* (2013.01); *G07F 17/3295* (2013.01)

(56) References Cited

U.S. PATENT DOCUMENTS

| | | | | |
|---|---|---|---|---|
| 6,264,561 | B1 | 7/2001 | Saffari et al. | |
| 6,602,133 | B2 | 8/2003 | Chan | |
| 6,604,740 | B1 | 8/2003 | Singer et al. | |
| 6,752,717 | B2 | 6/2004 | Vancura | |
| 6,780,109 | B2 | 8/2004 | Kaminkow | |
| 7,040,985 | B2 | 5/2006 | Vancura | |
| 7,108,602 | B2 | 9/2006 | Daly | |
| 7,237,775 | B2 | 7/2007 | Thomas et al. | |
| 7,291,069 | B2 | 11/2007 | Michaelson et al. | |
| 7,399,225 | B2 | 7/2008 | Kaminkow | |
| 7,736,223 | B2 | 6/2010 | Pace | |
| 8,118,660 | B2 | 2/2012 | Pace | |
| 8,469,792 | B2 | 6/2013 | Pace | |
| 8,491,369 | B2 | 7/2013 | Kowell | |
| 8,920,231 | B2 | 12/2014 | Pace | |
| 9,501,896 | B2 | 11/2016 | Pace | |
| 10,204,482 | B2 | 2/2019 | Pace | |
| 2003/0060276 | A1 | 3/2003 | Walker et al. | |
| 2003/0153382 | A1 | 8/2003 | Vancura | |
| 2004/0024666 | A1 | 2/2004 | Walker et al. | |
| 2004/0048660 | A1 | 3/2004 | Gentles et al. | |
| 2004/0053676 | A1* | 3/2004 | Rodgers | G07F 17/3244 463/20 |
| 2004/0127277 | A1 | 7/2004 | Walker et al. | |
| 2004/0133485 | A1* | 7/2004 | Schoonmaker | G07F 17/323 705/30 |
| 2004/0162135 | A1* | 8/2004 | Flanagan-Parks | G07F 17/3223 463/25 |
| 2004/0166940 | A1 | 8/2004 | Rothschild | |
| 2004/0176167 | A1 | 9/2004 | Michaelson et al. | |
| 2004/0219969 | A1* | 11/2004 | Casey | G07F 17/3232 463/20 |
| 2004/0224745 | A1 | 11/2004 | Bregenzer | |
| 2004/0224753 | A1 | 11/2004 | O'Donovan et al. | |
| 2005/0003883 | A1 | 1/2005 | Muir et al. | |
| 2005/0009599 | A1 | 1/2005 | Ryan | |
| 2005/0020344 | A1 | 1/2005 | Kaminkow | |
| 2005/0097359 | A1 | 5/2005 | Speare et al. | |
| 2005/0148384 | A1 | 7/2005 | Marks et al. | |
| 2005/0215311 | A1 | 9/2005 | Hornik et al. | |
| 2005/0261056 | A1* | 11/2005 | Smolucha | G07F 17/3239 463/25 |
| 2006/0040730 | A1* | 2/2006 | Walker | G07F 17/32 463/20 |
| 2006/0046831 | A1* | 3/2006 | Takano | G07F 17/3265 463/20 |
| 2006/0059571 | A1 | 3/2006 | Chen et al. | |
| 2006/0079321 | A1* | 4/2006 | Walker | G07F 17/3258 463/25 |
| 2006/0084495 | A1* | 4/2006 | Jaffe | A63F 13/10 463/20 |
| 2006/0089195 | A1 | 4/2006 | Walker et al. | |
| 2006/0160613 | A1 | 7/2006 | Hornik et al. | |
| 2006/0172796 | A1 | 8/2006 | Vancura | |
| 2006/0232004 | A1 | 10/2006 | Walker et al. | |
| 2006/0247031 | A1 | 11/2006 | Walker et al. | |
| 2007/0060252 | A1* | 3/2007 | Taylor | G07F 17/32 463/16 |
| 2007/0060279 | A1 | 3/2007 | Okada et al. | |
| 2008/0227525 | A1* | 9/2008 | Kelly | G07F 17/3276 463/20 |

OTHER PUBLICATIONS

Farley, "Report on the Review and Analysis of the Tic-Tac-Fruit Game," Letter to Kurt O. Gearhiser, Esq., Mar. 7, 2005.
Office Action for U.S. Appl. No. 11/694,283, dated Nov. 23, 2009.
Amendment for U.S. Appl. No. 11/694,283, dated Apr. 23, 2010.
Office Action for U.S. Appl. No. 11/694,283, dated Jun. 21, 2010.
Amendment After Final for U.S. Appl. No. 11/694,283, dated Sep. 21, 2010.
Advisory Action for U.S. Appl. No. 11/694,283, dated Oct. 2, 2010.
Request for Continued Examination (RCE) Transmittal for U.S. Appl. No. 11/694,283, dated Nov. 22, 2010.
Office Action for U.S. Appl. No. 11/694,283, dated Feb. 11, 2013.
Amendment for U.S. Appl. No. 11/694,283, dated Jul. 11, 2013.
Office Action for U.S. Appl. No. 11/694,283, dated Sep. 10, 2013.
Amendment for U.S. Appl. No. 11/694,283, dated Mar. 10, 2014.
Office Action for U.S. Appl. No. 11/694,283, dated May 16, 2014.
Response and Amendment to Final Office Action for U.S. Appl. No. 11/694,283, dated Aug. 15, 2014.
Notice of Allowance and Fee(s) Due for U.S. Appl. No. 11/694,283, dated Aug. 26, 2014.
Comments on Statement of Reasons for Allowance for U.S. Appl. No. 11/694,283, dated Nov. 24, 2014.
Part B—Fee(s) Transmittal for U.S. Appl. No. 11/694,283, dated Nov. 24, 2014.
Issue Notification for U.S. Appl. No. 11/694,283, dated Dec. 10, 2014.
Office Action for U.S. Appl. No. 14/584,430, dated Feb. 4, 2016.
Amendment After Non Final Rejection for U.S. Appl. No. 14/584,430, dated Jun. 6, 2016.
Final Rejection for U.S. Appl. No. 14/584,430, dated Aug. 17, 2016.
Applicant-Initiated Interview Summary for U.S. Appl. No. 14/584,430, dated Aug. 29, 2016.
Response After Final Action for U.S. Appl. No. 14/584,430, dated Aug. 31, 2016.
Notice of Allowance and Fee(s) Due for U.S. Appl. No. 14/584,430, dated Oct. 3, 2016.
Issue Fee Payment for U.S. Appl. No. 14/584,430, dated Oct. 19, 2016.
Issue Notification for U.S. Appl. No. 14/584,430, dated Nov. 2, 2016.
Kowell, Grant F.; Provisional Application for Patent; Method and Apparatus for Playing a Skill Game; U.S. Appl. No. 60/815,352; Jun. 21, 2006.
Fey, Marshall; Slot Machines; An Illustrated History of America's Most Popular Coin-Operated Gaming Device; First Edition; 1983.
Fey, Marshall; Slot Machines; A Pictorial History of the First 100 Years—The Colorful Story of the World's Most Popular Gaming Device; 1983 (First Printing), 1989 (Second Printing).
*Savvy Dog Systems, LLC et al.* v. *Pennsylvania Coin, LLC et al.*—Civil Action No: 3:19-cv-01470-JPW—Defendants' Initial Invalidity Contentions; Jun. 4, 2020.
*Savvy Dog Systems, LLC et al.* v. *Pennsylvania Coin, LLC et al.*—Civil Action No: 3:19-cv-01470-JPW—Defendants' Initial Invalidity Contentions—Exhibit A-1; Jun. 4, 2020.
*Savvy Dog Systems, LLC et al.* v. *Pennsylvania Coin, LLC et al.*—Civil Action No: 3:19-cv-01470-JPW—Defendants' Initial Invalidity Contentions—Exhibit A-2; Jun. 4, 2020.
*Savvy Dog Systems, LLC et al.* v. *Pennsylvania Coin, LLC et al.*—Civil Action No: 3:19-cv-01470-JPW—Defendants' Initial Invalidity Contentions—Exhibit A-3; Jun. 4, 2020.
*Savvy Dog Systems, LLC et al.* v. *Pennsylvania Coin, LLC et al.*—Civil Action No: 3:19-cv-01470-JPW—Defendants' Initial Invalidity Contentions—Exhibit A-4; Jun. 4, 2020.

(56) References Cited

OTHER PUBLICATIONS

*Savvy Dog Systems, LLC et al*. v. *Pennsylvania Coin, LLC et al*.—Civil Action No: 3:19-cv-01470-JPW—Defendants' Initial Invalidity Contentions—Exhibit A-5; Jun. 4, 2020.
*Savvy Dog Systems, LLC et al*. v. *Pennsylvania Coin, LLC et al*.—Civil Action No: 3:19-cv-01470-JPW—Defendants' Initial Invalidity Contentions—Exhibit A-6; Jun. 4, 2020.

* cited by examiner

| 300 PLAY DENOMINATION | 302 PLAYER RETURN | 304 OPERATOR PROFIT PER PLAY | 306 TOTAL PLAYS | 308 GAME PROVIDER PROFIT | 310 GAME PROVIDER CHARGE PER PLAY | 312 OPERATOR PROFIT PER FILL |
|---|---|---|---|---|---|---|
| 0.25 | 85% | $0.0375 | 200K | 15.6% | $0.00585 | $7,500.00 |
| 0.50 | 87% | $0.0650 | 140K | 12.9% | $0.00836 | $9,100.00 |
| 0.75 | 89% | $0.0825 | 130K | 10.9% | $0.009 | $10,725.00 |
| 1.00 | 90% | $0.1000 | 120K | 9.75% | $0.00975 | $12,000.00 |
| 2.00 | 92% | $0.1600 | 85K | 8.60% | $0.01376 | $13,600.00 |
| 3.00 | 93% | $0.2100 | 75K | 7.43% | $0.0156 | $15,750.00 |
| 4.00 | 94% | $0.2400 | 75K | 6.50% | $0.0156 | $18,000.00 |
| 5.00 | 95% | $0.2500 | 75K | 6.24% | $0.0156 | $18,750.00 |

FIG 3

| CRD (400) | VALUE (402) | COUNT (404) | PLAYS (406) | RATE USE% (408) | LEFT (410) |
|---|---|---|---|---|---|
| 1 | $0.25 | 200,000 | 0 | 0.0000% | 199,982 |
| 2 | $0.50 | 140,000 | 2 | 0.0014% | 139,988 |
| 3 | $0.75 | 130,000 | 0 | 0.0000% | 129,988 |
| 4 | $1.00 | 120,000 | 1 | 0.0008% | 119,989 |
| 8 | $2.00 | 85,000 | 0 | 0.0000% | 84,992 |
| 12 | $3.00 | 75,000 | 0 | 0.0000% | 74,993 |
| 16 | $4.00 | 75,000 | 5 | 0.0067% | 74,993 |
| 20 | $5.00 | 75,000 | 0 | 0.0000% | 74,993 |
| COLUMN TOTALS | | | 8 | 0.0089% | |

FIG. 4

| 500 ITEM | 502 PLAY VALUE | 504 MILLICENT CHARGE | 506 BANK USE COUNTER | 508 LINE ITEM TOTAL |
|---|---|---|---|---|
| 1 | OTHER | 0 | 0 | $0.00 |
| 2 | 0.00 | 0 | 0 | $0.00 |
| 3 | $0.25 | 915 | 5 | $0.04 |
| 4 | $0.50 | 1740 | 0 | $0.00 |
| 5 | $0.75 | 2475 | 0 | $0.00 |
| 6 | $1.00 | 3120 | 5 | $0.15 |
| 7 | $1.25 | 3675 | 3 | $0.11 |
| 8 | $1.50 | 4140 | 0 | $0.00 |
| 9 | $1.75 | 4515 | 0 | $0.00 |
| 10 | $2.00 | 4800 | 2 | $0.09 |
| COLUMN TOTALS | | | 15 | $0.39 |

FIG. 5

DAWG GONE FUN ™

FINITE STATS

TTF539(C)
3/04/07 09:53: 47
ACCLEV: 5:FACTORY
B/TERMID: MP:99999
C/LICENS: 08:00000
==========
ERROR WARNG FAULT
MAIN CASH LOGIC
PRNTR: CITIZEN3551
==========

CONTIN TEST | ONE TEST | SHOW PERCNT

RETURN TO STATS MENU

TYPE: ATEUP GAME: TIC-TAC-FRUIT
PLAY LEVEL: 0.0000%

| PLAY RATE | | $0.25 | $0.50 | $0.75 | $1.00 | $2.00 | $3.00 | $4.00 | $5.00 |
|---|---|---|---|---|---|---|---|---|---|
| LINE CYCLE: | | 0 | 0 | 0 | 0 | 0 | 0 | 0 | 0 |
| LINE | TOTAL | LEFT | LEFT | LEFT | LEFT | LEFT | LEFT | LEFT | LEFT |
| 1 | 13 | 0 | 0 | 0 | 0 | 0 | 0 | 0 | 0 |
| 2 | 15 | 0 | 0 | 0 | 0 | 0 | 0 | 0 | 0 |
| 3 | 11 | 0 | 0 | 0 | 0 | 0 | 0 | 0 | 0 |
| 4 | 1 | 0 | 0 | 0 | 0 | 0 | 0 | 0 | 0 |
| | 40 | 0 | 0 | 0 | 0 | 0 | 0 | 0 | 0 |

| PLAY RATE | | $0.25 | $0.50 | $0.75 | $1.00 | $2.00 | $3.00 | $4.00 | $5.00 |
|---|---|---|---|---|---|---|---|---|---|
| TIER CYCLE: | | 0 | 0 | 0 | 0 | 0 | 0 | 0 | 0 |
| TIER | TOTAL | LEFT | LEFT | LEFT | LEFT | LEFT | LEFT | LEFT | LEFT |
| 1 | 1 | 0 | 0 | 0 | 0 | 0 | 0 | 0 | 0 |
| 2 | 100 | 0 | 0 | 0 | 0 | 0 | 0 | 0 | 0 |
| 3 | 466 | 0 | 0 | 0 | 0 | 0 | 0 | 0 | 0 |
| 4 | 1020 | 0 | 0 | 0 | 0 | 0 | 0 | 0 | 0 |
| 5 | 2400 | 0 | 0 | 0 | 0 | 0 | 0 | 0 | 0 |
| 6 | 15000 | 0 | 0 | 0 | 0 | 0 | 0 | 0 | 0 |
| 7 | 18637 | 0 | 0 | 0 | 0 | 0 | 0 | 0 | 0 |
| 8 | 22376 | 0 | 0 | 0 | 0 | 0 | 0 | 0 | 0 |
| | 60000 | 0 | 0 | 0 | 0 | 0 | 0 | 0 | 0 |

FIG. 10

DAWG GONE FUN ™

FILL STATS

TTF539(C)
3/04/07 09:53: 55
ACCLEV: 5:FACTORY
B/TERMID: MP:99999
C/LICENS: 08:00000
==========
ERROR WARNG FAULT
MAIN CASH LOGIC
PRNTR: CITIZEN3551
==========

RETURN TO STATS MENU

PLAY RATE FILL SYSTEM

PLAYSLEVEL = 0.0000%
FILL COUNT = 0
PENDINGFILL = 0.0
CURRENTFILL = 0.0

PRINT FILL STATS

LICENSE TIMER:
DAYS HR MN SC
TIME EXPIRED!

---- FIRST FILL ---
--/--/-- --:--:--
---- LAST FILL ----
--/--/-- --:--:--

| LAST TRMID | PLAY RATE | TARGET COUNT | BANKPLA COUNTER | PLAYLEVEL RATE-USE% |
|---|---|---|---|---|
| - - - - | $0.25 | 0 | 0 | 0.0000% |
| - - - - | $0.50 | 0 | 0 | 0.0000% |
| - - - - | $0.75 | 0 | 0 | 0.0000% |
| - - - - | $1.00 | 0 | 0 | 0.0000% |
| - - - - | $2.00 | 0 | 0 | 0.0000% |
| - - - - | $3.00 | 0 | 0 | 0.0000% |
| - - - - | $4.00 | 0 | 0 | 0.0000% |
| - - - - | $5.00 | 0 | 0 | 0.0000% |
| - - - - | OTHER | - - - - | - - - - | - - - - - - - |
| | $0.00 | | 0 | 0.0000%1 |

FIG. 11

SECURITY METHOD AND SYSTEM FOR ELECTRONIC GAME VIRTUAL REFILL CARTRIDGE

CROSS-REFERENCE TO RELATED APPLICATION

The present patent application is a continuation of previously filed, co-pending U.S. patent application Ser. No. 15/357,755, filed Nov. 21, 2016, which is a continuation of previously filed U.S. patent application Ser. No. 14/584,430, filed Dec. 29, 2014, which is a continuation of previously filed U.S. patent application Ser. No. 11/694,283, filed Mar. 30, 2007, which claims priority from previously filed U.S. Provisional Patent Application Ser. No. 60/788,363, filed Mar. 31, 2006.

INCORPORATION BY REFERENCE

The specifications and drawings of U.S. patent application Ser. No. 15/357,755, filed Nov. 21, 2016, U.S. patent application Ser. No. 14/584,430, filed Dec. 29, 2014, U.S. patent application Ser. No. 11/694,283, filed Mar. 30, 2007, and U.S. Provisional Patent Application Ser. No. 60/788,363, filed Mar. 31, 2006, are specifically incorporated herein by reference as if set forth in their entirety.

BACKGROUND

The present invention is related generally to amusement and entertainment electronic gaming and, more particularly, to a method and system for controlling the refills and for reconfiguring features of an amusement or entertainment electronic game having a virtual game cartridge.

Amusement and entertainment type electronic games have become very popular with the public and, as their popularity has increased, several states have legalized certain types of gaming but under heavy regulation. For example, skill-based amusement machines are permitted in some states. Generally, to qualify as a skill-based amusement machine, the outcome of play during the game must be controlled by the person playing the game and not by predetermined odds or random chance controlled by the machine. Some chance can be part of a skill-based amusement game, but skill must be the predominant feature. The play on the machine must involve a task, game, play, contest, competition or tournament in which the player actively participates.

With the increasing popularity of electronic games, the number of games that are copied and passed off as an original game has also increased dramatically. Unscrupulous persons in the electronic gaming industry have not only made illegal copies of game processor boards, but have also altered features of legally-installed electronic games by circumventing certain features of the game. For example, one feature that has been altered is that of limiting the plays of the game that are licensed by an operator to bypass the requirement for obtaining a new passcode to reactivate play after all licensed game plays have been used.

What is needed in the electronic gaming art are techniques that will ensure that only properly identified and licensed electronic games will receive a securely-generated passcode that will enable the operator to reset game plays on the licensed game and reconfigure the electronic game to meet the operator's requirements.

SUMMARY

The present invention is directed to a system, method and program product for controlling the operation and configuration of an electronic game terminal. Embodiments of the invention include a code exchange system to ensure that fills and refills of a virtual electronic game cartridge are handled securely. Each electronic game terminal is provided with a unique identifier that forms part of the codes that are exchanged between the operator of the electronic game terminal operator and the electronic game provider that develops the hardware and software components that form the installed game console. Various communication means can be used in embodiments of the invention including web-based electronic communication.

In one aspect of the invention, a method is provided for controlling the operation and configuration of an electronic game terminal. A passcode is generated for activating plays on the electronic game terminal. An operator is enabled to enter the passcode into a control component for the electronic game terminal. A maximum number of electronic games that can be played before the electronic game terminal is deactivated is set. The number of games remaining following each play of the electronic game is dynamically determined. A request is received from the operator to refill the game plays on the electronic game terminal. A new passcode is generated wherein the new passcode can enable or disable at least one feature of the electronic game. The new passcode is provided to the operator to enter in order to enable additional plays on the electronic game terminal. The computer program product implements the method for controlling the operation and configuration of an electronic game terminal. The system includes a plurality of components for performing the steps of the method.

BRIEF DESCRIPTION OF THE DRAWINGS

These and other advantages and aspects of the present invention will become apparent and more readily appreciated from the following detailed description of the invention taken in conjunction with the accompanying drawings, as follows.

FIG. 3 illustrates an exemplary payout scheme for varying denominations of play in an exemplary embodiment.

FIG. 4 illustrates game terminal status receipts available to the operator of electronic games in the "plays level" exemplary embodiment.

FIG. 5 illustrates game terminal status receipts available to the operator of electronic games in a "license timer" exemplary embodiment.

FIG. 10 illustrates a finite statistics display useful in examining game play statistics by an operator in an exemplary embodiment.

FIG. 11 illustrates a play rate fill system statistics display useful to monitor the play rate fill system by an operator in an exemplary embodiment.

DETAILED DESCRIPTION

Figure 1A:
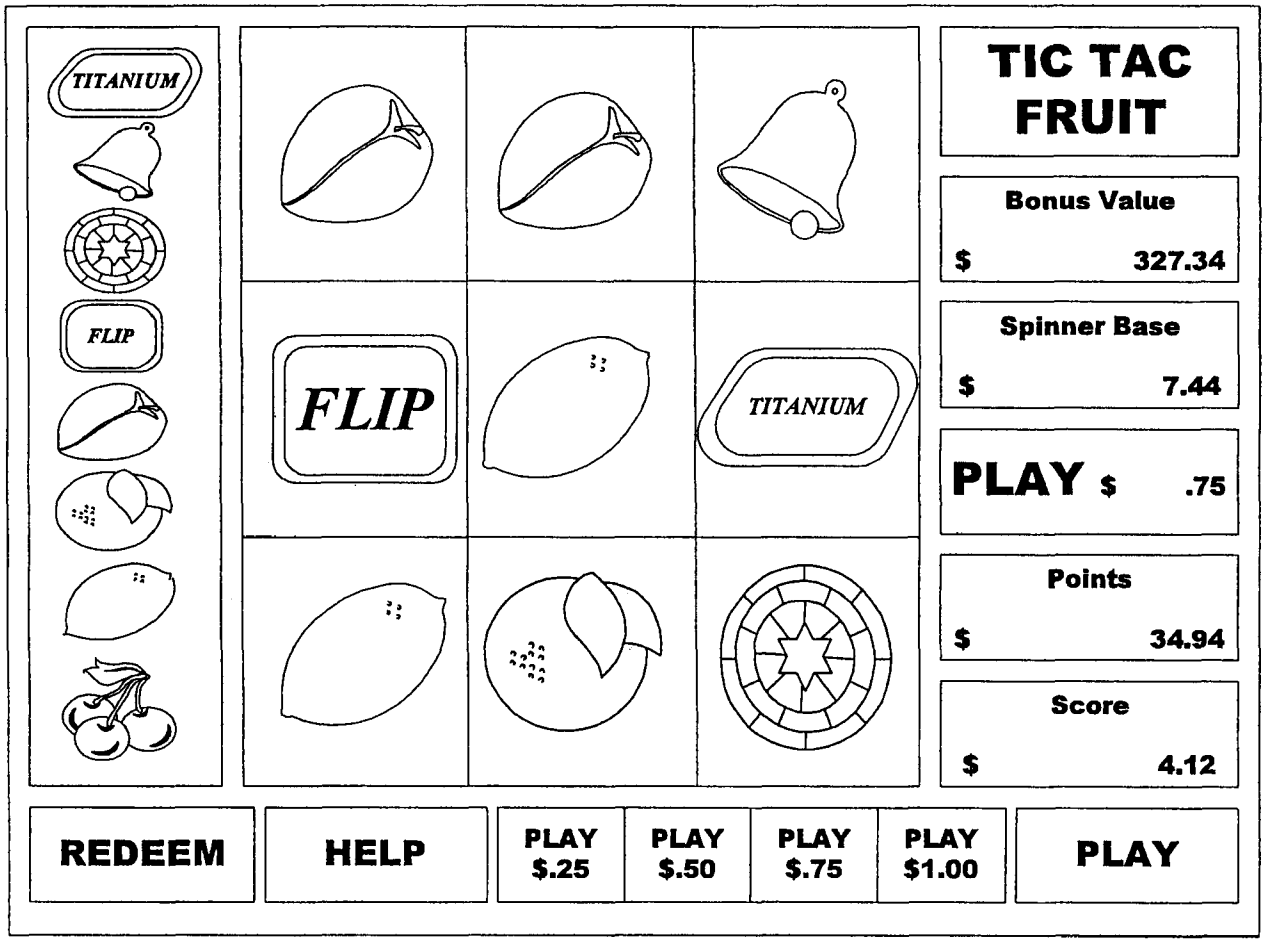
FIGS. 1A-1B illustrate electronic game displays for a skill-based game in which the present invention can be implemented.

The following description of the invention is provided as an enabling teaching of the invention and its best, currently known embodiment. Those skilled in the relevant art will recognize that many changes can be made to the embodiments described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and may even be desirable in certain circumstances, and are a part of the present invention. Thus, the following description is provided as illustrative of the principles of the present invention and not in limitation thereof, since the scope of the present invention is defined by the claims.

Embodiments of the present invention will be described in the context of the Tic-Tac Fruit electronic skill-based amusement game developed and licensed by Pace-O-Matic, Inc. Tic-Tac Fruit is a game loosely derived from tic-tac-toe that uses player skill to solve a puzzle. The similarity to tic-tac-toe extends from the use of a field or grid of nine spots or tiles arranged in a three by three array on the game display. On each play of the electronic game, the game software program constructs a puzzle or task for the player to solve. The electronic game always incorporates at least one correct solution and sometimes generates alternative solutions that may not provide the same prize as the best solution.

In the embodiment described herein, the Tic-Tac-Fruit game possesses a finite number of plays. The game is configured with "virtual" electronic cartridges that contain a finite pool of game plays based upon eight different levels of winning prize values. The electronic cartridges are not accessible to the operator of the machine and cannot be changed. When the current allotment of finite game plays in one cartridge is depleted, the next cartridge is automatically selected by the device. When all of the electronic cartridges are depleted, the device will become disabled with a message stating "out of plays" on the lower center of the video screen. The device operator must purchase additional pools of game plays, which will be enabled with the correct entry of a digital pass code provided by the electronic game provider. In an exemplary embodiment described below, the passcode contains 12 digits in four groups of three digits to facilitate accurate and quick entry by the game operator. Configuration of game play for a specific machine can only be done by software programming. However, the multi-digit passcode that is generated can be used to reset or reconfigure electronic game settings.

The quantity of game plays is also game theme specific, i.e., it varies based on the particular version of the Tic-Tac-Fruit electronic game that is placed in a venue. For the embodiment described herein, there are three electronic cartridges provided with the game, with thirty-thousand plays per electronic cartridge for a total number of ninety thousand game plays. The particular number of game plays for each version of the Tic-Tac-Fruit game is purchased by a device operator. The operator pays a flat licensing fee in order to obtain the digital pass code that must be correctly entered in order to enable the appropriate quantity of game plays for the various game themes.

Each purchase level of each game theme is merely a multiple of a lowest game purchase level. Therefore, all game outcomes are derived from the same finite pool of game outcomes, regardless of purchase amount. Each time the player engages play, an outcome is selected at random from the finite pool of game outcomes. The manner in which the player plays the game determines whether the player will receive the winnings or if the winnings will go into the bonus pool, which will be awarded to the next player successfully obtaining the top prize.

By using the concept of a virtual cartridge to reload the software for an electronic game console for additional plays, the electronic game service provider is limited to a licensing fee for the game software which permits a finite number of plays, 30,000 per virtual cartridge, 90,000 total plays in the case of the Tic-Tac-Fruit game used as an example herein.

By way of example, and not limitation, the Tic-Tac-Toe electronic game play is described in detail herein as an example of an electronic game using the concept of finite play virtual cartridges and refills of the virtual cartridges. Following this description, more specific aspects of embodiments of the invention to control refills will be described.

The Tic-Tac-Fruit electronic game is a single player game. The player is presented a field completely filled with apparently random symbols selected from a set of nine symbols that includes a "wild card" symbol. The game constructs the field so that the initial field does not place three of the same symbols in a row wherein a row is interpreted as being oriented horizontally, vertically, or diagonally. With a three by three field, there are eight possible lines: three horizontal lines, three vertical lines, and two diagonal lines. The player gets a choice of replacing one of the initial nine spots or tiles with a wild card symbol. The game's construction of the field guarantees that at least one line may be formed by placing the wild card selection in the proper spot. On average, two lines may be formed if the optimal spot for the wild card symbol is selected. However, there is always the possibility that at least one line can be formed.

The player's skills enters into play as the player is given a short period of time in which to choose the "wild card" location. Since some symbols are more valuable than others and some wild card locations may complete multiple lines, a player must quickly examine all nine locations and determine the optimal wild card location. Once the player selects a location, the game converts the selection to a wild card and examines the field for complete lines and awards points accordingly.

Since there are eight symbols and nine spots on the field, the total number of combinations is approximately 134 million. However, since a field cannot have any initial complete lines, the total number of initial combinations is reduced to approximately 118 million. Valid fields are determined by using an embedded computer processor to iterate through and test each combination to determine if it has any complete lines. If any lines are complete, the combination is not counted or used. The game software determines all of the initial "no-line" fields and tests each of these for potential winners where all fields that can potentially complete a line are counted. Since there are over 100 million compliant field combinations, the player must examine each lineup and symbol values to determine the best location for selecting the wild card on the field displayed.

The Tic-Tac-Fruit electronic game does not pick random fields until testing indicates that one is acceptable. Instead, the field is constructed to meet certain criteria. The steps involved in constructing a field in this electronic game are as follows:

1. chose the number of winning lines (i.e., 1, 2, 3, 4);
2. chose the orientation of each of the winning lines (i.e., horizontal, vertical, or diagonal);
3. chose the symbols for each of the lines (i.e., cherries, plums, bells, etc.);
4. fill in empty spots with random symbols; and
5. test the complete field for compliance with the goals set by steps 1 and 3 and repeat the construction process if compliance fails.

Figure 1B:
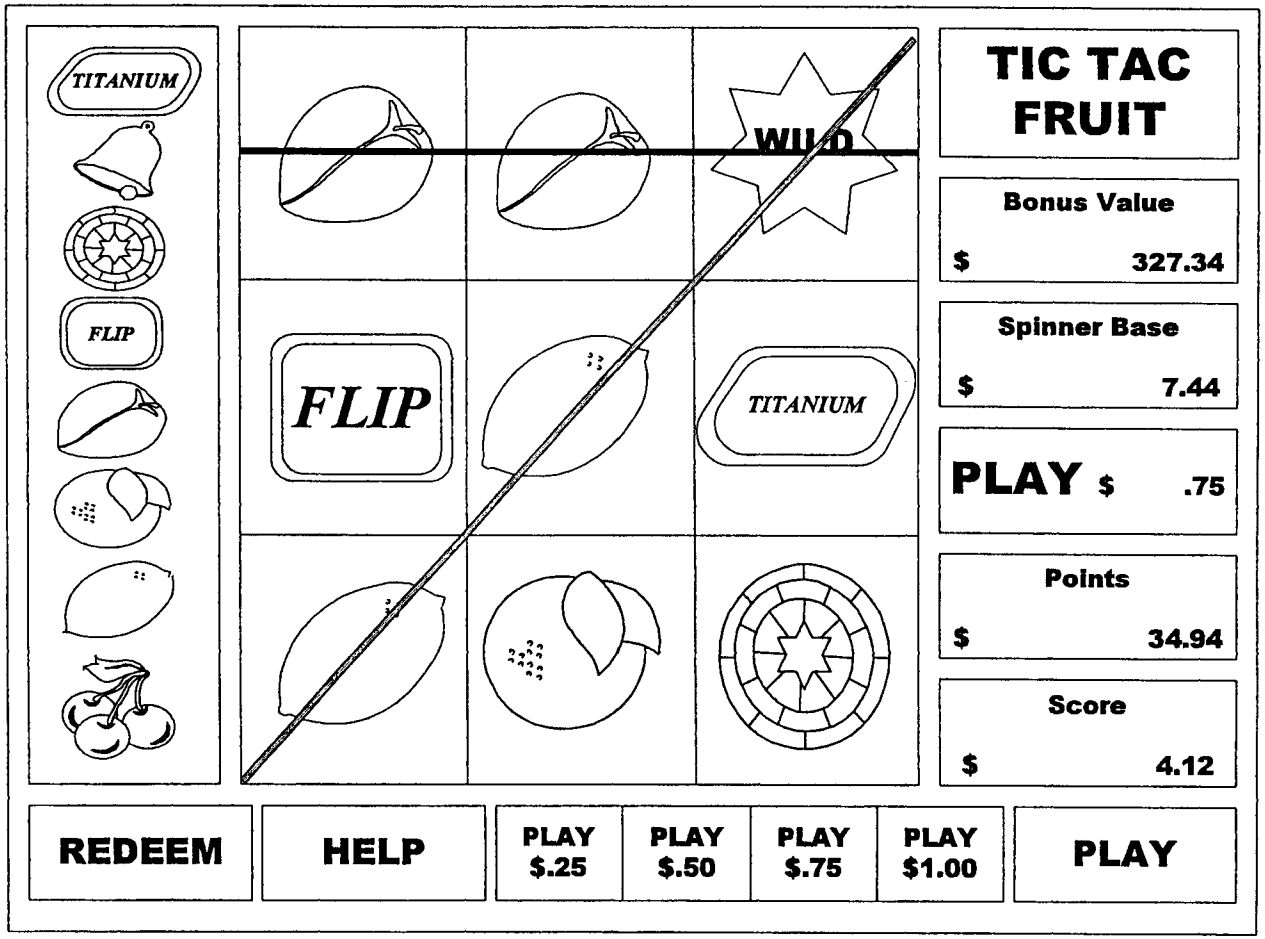

One variation of the Tic-Tac-Fruit electronic game presents a game theme that is based primarily on fruit symbols. There are eight symbols and therefore eight different winning combinations. An exemplary touch screen display for this game is illustrated in FIG. 1A. The different symbols that can be displayed are shown in the left column of the display. The player selects a denomination for the next play of the game from among the denominations available on the bottom of the display. In this example, the player has selected $0.75. The game grid depicted does not show any complete lines. Once the player selects the "Play" icon, he must decide which symbol on the display grid to select as the wild card. As illustrated in FIG. 1B, the player selected the space in the upper right corner of the display grid which resulted in the simultaneous completion of two lines, i.e., a horizontal line and a diagonal line.

An exemplary award schedule for this version of the Tic-Tac-Fruit electronic game is provided in Table 1. The column headings represent denominations of play. In other words, the column heading represent the amount that the player can select for each play. The higher the denomination selected, the greater the potential winnings for each of the winning combinations. For example, if the player selects fifty cents as the denomination for the next play of the electronic game, and completes a line with three titanium symbols, he will win the equivalent of $250.00 in points. Had he successfully played the same game with a $4.00 denomination of play, his winnings would have been the equivalent of $2,000.00 in points. Likewise, if the player had selected a denomination of $2.00 and made a wild card selection that simultaneously completed a line of three bells and a line of three plums, his winnings would have been the equivalent of $14.00 in points, $10.00 for the line of three bells and $4.00 for the line of three plums. The prizes marked with an asterisk are progressive value prizes. The value awarded for these prizes will increase with every game played.

TABLE 1

Tic-Tac-Fruit (Classic)

| | Denomination | | | |
|---|---|---|---|---|
| Symbol | 50¢ | $1.00 | $2.00 | $4.00 |
| 3 Titanium | $250* | $500* | $1,000* | $2,000* |
| 3 Spinner | 80¢ | $1.60* | $3.20* | $6.40* |
| 3 Flip | * | * | * | * |
| 3 Bell | $2.50 | $3 | $10 | $20 |
| 3 Plum | $1 | $2 | $4 | $8 |
| 3 Orange | 8¢ | 16¢ | 32¢ | 64¢ |
| 3 Lemon | 4¢ | 8¢ | 16¢ | 32¢ |
| 3 Cherry | 2¢ | 4¢ | 8¢ | 16¢ |

In game operation, a player inserts money into the Tic-Tac-Fruit electronic game device through a bill acceptor located on the front of the electronic game cabinet or console beneath the button panel. The bill acceptor accepts U.S. notes of varying denominations. Bills inserted are displayed on the video screen as points available for game play. The player selects the denomination of play by touching the appropriate icon for the price of game play. A player may change the desired denomination at any time prior to engaging in game play.

Game play begins with the player touching the "Play" icon on the video screen or pressing the "Play/Credit" button on the cabinet exterior. The video screen presents nine symbols in a three by three array to the player as discussed above. The object of the game is for the player to recognize the most rewarding game outcome and to select the appropriate symbol to change to a wild card in order to obtain the most valuable prize available for the displayed field.

As described above, the initial nine symbols displayed will not present an automatic winning combination. The player must engage in the selection of the symbol to be replaced with a "wild card" in order to obtain a winning game outcome. The player has a finite length of time in which to select the appropriate symbol to replace. Failure to select a symbol in the allotted time will result in a losing game outcome. In such an instance, the amount that would have been won is revealed to the player and placed into the "bonus pool" that will be won by the player successfully obtaining the top prize. Likewise, if a player selects a symbol to replace with a wild card that does not obtain a winning outcome, or the best possible winning outcome, the amount that was not won is added to the bonus pool in an exemplary embodiment. In the case of the player not obtaining the best possible outcome, the difference between the prize won and the best possible prize is added to the bonus pool.

Essentially, the Tic-Tac-Fruit electronic game presents a task whereby the player must select the appropriate symbol to replace with a wild card symbol in an effort to obtain the highest value game outcome offered by the device. The prize is determined by a random selection from a finite pool of available prizes. The device selects the quantity of lines that will present a winning outcome. Prizes may be presented on one, two, three, or four lines in a single game play. The device selects the level of prize(s) to be awarded. A software algorithm assesses the arrangement of the prize(s) to be offered to assure that no other, more valuable prizes will inadvertently be presented. The key symbol needed to obtain the highest value prize is replaced with a non-winning symbol prior to display to the player.

The player may redeem accumulated credits after game play. Redemption of the credits is accomplished simply by pressing the "Ticket" button or touching the "Redeem" icon on the video screen. All accumulated credits will be redeemed as a cash voucher on a printed ticket. The printed ticket can be presented to a redemption counter within the venue for cash payment.

One problem with this system of operation is that the operator of the game receives 90,000 plays regardless of the denominations selected for play by the game players. The electronic game in one exemplary embodiment provides the player with four different play levels, e.g., $0.50, $1.00, $2.00 and $4.00. The operator can have the game console provide other denominations of play instead. If players play the electronic game at the $0.50 level and use all 90,000 plays available, the operator is going to make far less in profit than if the players had selected the $4.00 level for all plays. From the electronic game service provider's perspective charging a flat fee for the virtual cartridges, if all the games are played at the lowest denomination, the game operator may not make sufficient profit to make keeping the game console installed at the operator's location worthwhile. On the other hand, the flat fee charged may result in too small a profit for the electronic game service provider. Under most current state laws, the game provider does not have the option of charging the operator a fixed percentage of his profits for leasing the electronic game and software. An additional problem with playing an electronic game with a finite structure having a "jackpot" for each virtual cartridge is that the operator has access to information on the number of plays still remaining and could take advantage of this information to play the remaining games at the highest denomination to win the jackpot amount.

An embodiment of the invention solves this problem by having a finite structure for each denomination of play. The electronic game service provider still charges a flat licensing fee for each reload of the virtual cartridges. However, instead of a having a fixed number of plays available per each refill of the virtual cartridges, the number of plays available are based on the denominations that are available for player selection and are dynamically updated during operation of the game plays based on the actual denominations used by the players during game play on the electronic game console as described more fully below. For example, if all games are played at a $0.25 level, the operator could get 200,000 plays per refill. If all games are played at a $5.00 level, the operator could get 75,000 plays per refill. Since each game will be played multiple times at each possible denomination, the number of games remaining at each denomination is determined dynamically after each play. Note that in the context of this invention, the terms denomination of play and level of play are used interchangeably. Although the invention is described in terms of an exemplary embodiment, the scope of the claims are not limited to the exemplary embodiments disclosed.

Figure 2:
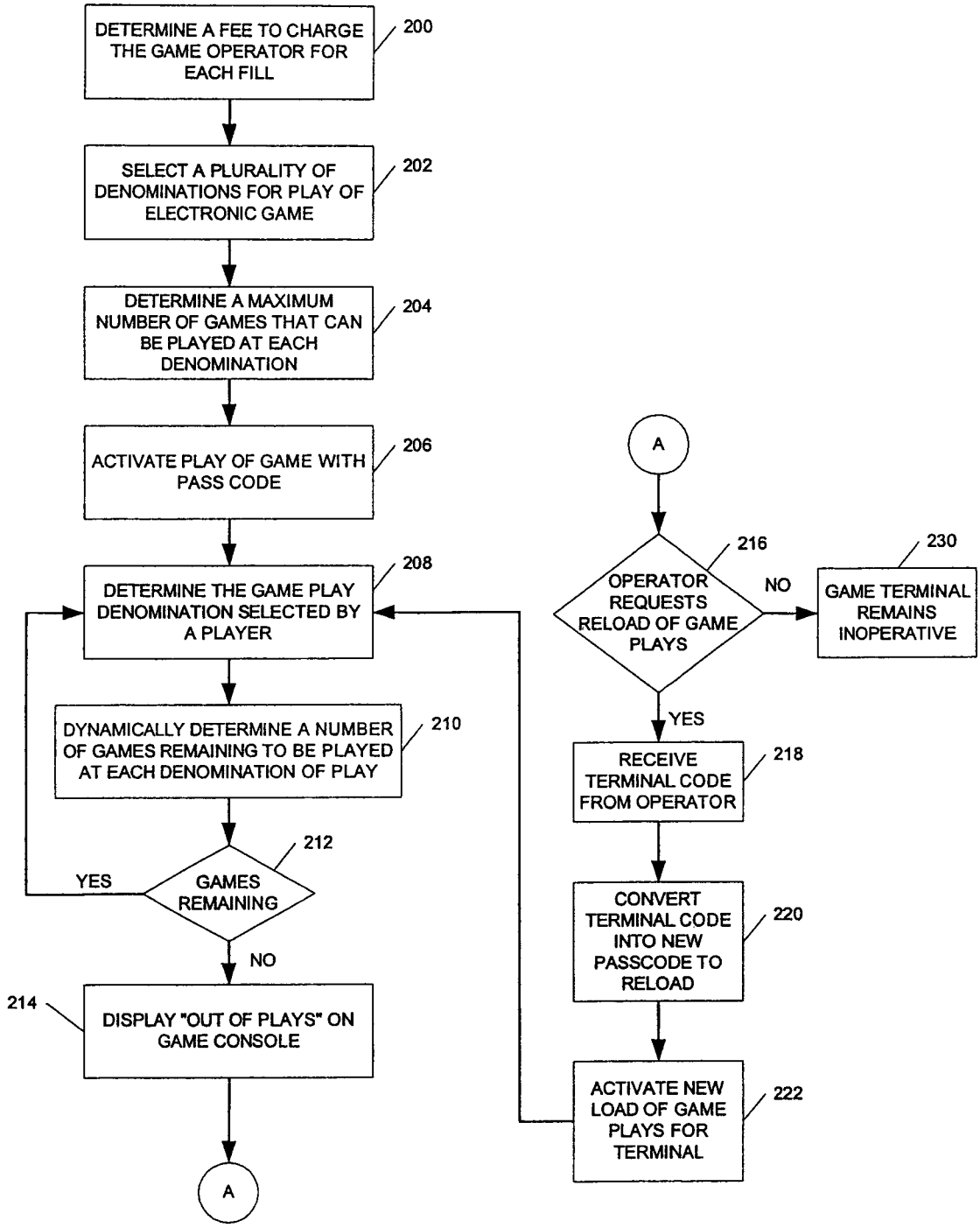
FIG. 2 illustrates processing logic for determining the remaining number of plays of an electronic game that are available at different denominations of play in an exemplary embodiment of the invention.

FIG. 2 illustrates processing logic for determining the remaining number of plays of an electronic game that are available at different denominations (i.e., levels) of play in an exemplary embodiment. The first few steps of the processing logic are performed before activation of the electronic game at the operator's venue with a "fill" or load of game plays. The electronic game service provider first determines the flat fee to be charged for the fill of game plays as indicated in block 200. A plurality of denominations for play of the electronic game is selected as indicated in block 202. The denominations for an electronic game terminal can be preset by the electronic game service provider and changed by the operator. The electronic game service provider determines a maximum number of games that can be played at each of the plurality of denominations as indicated in block 204. This determination is made for each possible denomination of play although only four denominations are initially selected in the embodiment used for the Tic-Tac-Fruit game. The electronic game service provider provides a passcode that is generated from the terminal identifier to the operator. The operator then enters the passcode to activate game play as indicated in block 206. The electronic game software determines the denomination of play selected by the player in block 208. After each play of the game, the game software dynamically determines the number of games remaining to be played at each denomination of play as indicated in block 210. The number determined for each denomination of play reflects the number of games that could be played at the particular level of play.

After determining the number of plays remaining at each denomination, the game software determines if there are remaining games to be played as indicated in decision block 212. If there are games remaining to be played, the software returns to process block 208 for the next play of the game. If there are no games remaining to be played, the electronic game displays an "out of plays" message on the electronic game display as indicated in block 214. Next, in decision block 216, a determination is made as to whether the operator has requested a refill of game plays. Unless the operator requests a refill of the virtual game cartridge, the electronic game terminal remains inoperative as indicated in block 230. The operator requests a refill of game plays by sending the terminal identifier and other information displayed on an operator menu, as described herein, to the electronic game service provider in order to obtain a new passcode to reactivate (i.e., refill plays) the electronic game. The processing logic then returns to block 208 to wait for the next play of the electronic game.

Upon receiving the operator request for a refill of game plays (block 218), the electronic game service provider generates a new passcode for refilling the electronic game terminal that is based on the terminal identifier as indicated in block 220. The electronic game terminal is reactivated for play by entering the passcode into the terminal as indicated in block 222.

FIG. 3 illustrates an exemplary payout scheme for varying denominations of play in an exemplary embodiment. For the Tic-Tac-Fruit game used as an example herein, the electronic game service provider enables the operator to select four denominations for play. The first column 300 depicts the play denominations that can be selected. The second column 302 shows how much of the game play amount is returned to the player on average at each possible play denomination. The operator's profit per each game played at a particular denomination is shown in the third column 304. The total number of plays available at each denomination, if all game plays were made at a single denomination, is shown in the fourth column 306. As can be seen, the total number of plays available for each denomination per load varies non-linearly from 200K at the $0.25 level of play to 75K at the $3.00, $4.00 and $5.00 levels of play. The total number of games per load will vary based on actual denominations selected by the players. The electronic game service provider's profit at each denomination of play is shown in the fifth column 308. The percentage shown is expressed as a percentage of the operator's per game profit. For example, the electronic game service provider's profit per play at the $4.00 level of play is $0.0156 which is 6.5% of the operator's corresponding profit of $0.21 per play. It should be noticed that in this example, the game provider profit per play is variable and non-linear based on the different denominations. The next column 310 indicates the equivalent amount that the game provider would have to "charge per each play" at each denomination to reach the flat fee that is actually charged per load. In other words, the electronic game service provider charges a flat fee per load of the virtual cartridges. If all the games were played at a particular denomination, e.g., $1.00, the total number of games played allowed by the game software control would be 120K and the equivalent game provider charge per play at this level would be $0.00975. The last column 312 indicates the operator's total profit per fill of the virtual cartridge if all games were played at the particular denomination. For example, if all games were played at the $0.25 level, the operator would make a total profit of $7500 taking into consideration the percentage amount returned to game players. If all games were played at the $5.00 level, the operator's profit per fill would be $18,750.00.

FIG. 4 illustrates game terminal status receipts available to the operator of electronic games in the "plays level" exemplary embodiment. In FIG. 4, the first column 400 labeled "CRD" represents multiples of the lowest denomination game play ($0.25 in this example). The second column 402 labeled "Value" indicates the denomination of play, ranging from $0.25 to $5.00. The third column 404 labeled "Count" represents the number of plays available at a particular denomination, if all games were played at the same level. The fourth column 406 labeled "Plays" indicates the number of games played at the corresponding levels in the "Value" column. In this sample terminal status receipt, two games have been played at the $0.50 level, one game at the $1.00 level and five games at the $4.00 level. The column total shows that eight games have been played on this game terminal. The next column 408 labeled "Rate-Use %" indicates the percentage of games that have been played at the corresponding play level. For example, 0.0067% of the available games at the $4.00 level per virtual cartridge load have been played. The final column 410 labeled "Left" indicates the remaining number of games available at a particular pay level as game play proceeds. The numbers in this column are determined dynamically after each game play. After the first eight game plays, there are 74,993 games remaining at the $3.00, $4.00 or $5.00 levels. The numbers in this column take into consideration each previous play of the electronic game and the denomination at which each game was played.

FIG. 5 illustrates game terminal status receipts available to the operator of electronic games in another exemplary embodiment. The game terminal status receipt illustrated in FIG. 5 is based on an electronic game concept referred to as the license timer. The use of this concept is particularly applicable to Class II games on Indian land. In this approach to controlling game play, the operator is provided with software that enables an electronic game terminal to be played for a fixed period of time, such as 30 days or 60 days. Typically, a number of electronic game terminals are networked together with one terminal being the server master and the other terminals being the client slaves. After the fixed period of time, the software license times out and the electronic game cannot be played any further except by receiving a new code to provide a reset of the electronic game timer mechanism. The master terminal generates a multi-digit code which must be provided to the electronic game service provider in order to receive a new code to activate terminal operation. The terminal-generated code contains encrypted information that indicates how much revenue each terminal is generating. The electronic game service provider charges a percentage of the revenue earned by each terminal for each fixed period of use of the electronic game. Depending on the denominations that are being played on each game terminal, the operator makes a variable amount of revenue, with the electronic game provider receiving a specified percentage of the operator's revenue for the period of time that the game is licensed. A problem with this basis for revenue is that the operators frequently under-report the revenue generated by the terminals during the license period.

The finite structure concept for the plays level invention described above has been combined with the license timer concept to increase the electronic game provider's revenue per license period. Instead of varying the number of plays available at each denomination, a charge is made per game played at each denomination level in a non-linear manner as exemplified in FIG. 5. Column 500, labeled "Item" simply provides a sequential item number that corresponds to the different denominations of play. The denominations of play are provided in column 502 labeled "Play Value." The next column 504 is labeled "Millicent Charge" and represents the variable amount charged by the electronic game service provider for each play value. For example, for a play level denomination of $2.00, the game terminal operator is charged $0.048 per play. The next column 506 is labeled "Bank Use Counter" and represents the number of plays at the corresponding play value. The total for this column is the total number of game plays on the terminal during the licensed period. The final column 508 labeled "Line Item Total" is simply the product of the previous two columns (i.e., Millicent charge and bank use counter). It represents the amount owed by the terminal operator to the electronic game service provider for the actual plays at a particular play value. The column total ($0.39) is the amount that the operator owes to the electronic game service provider for the 15 total plays at different play values. As game play progresses, the last two columns are continuously updated. When the software license expires after the license period, the operator must pay the amount identified as the total of the line item amounts in order to receive a code to activate the electronic game for another fixed period of time.

Figure 6:
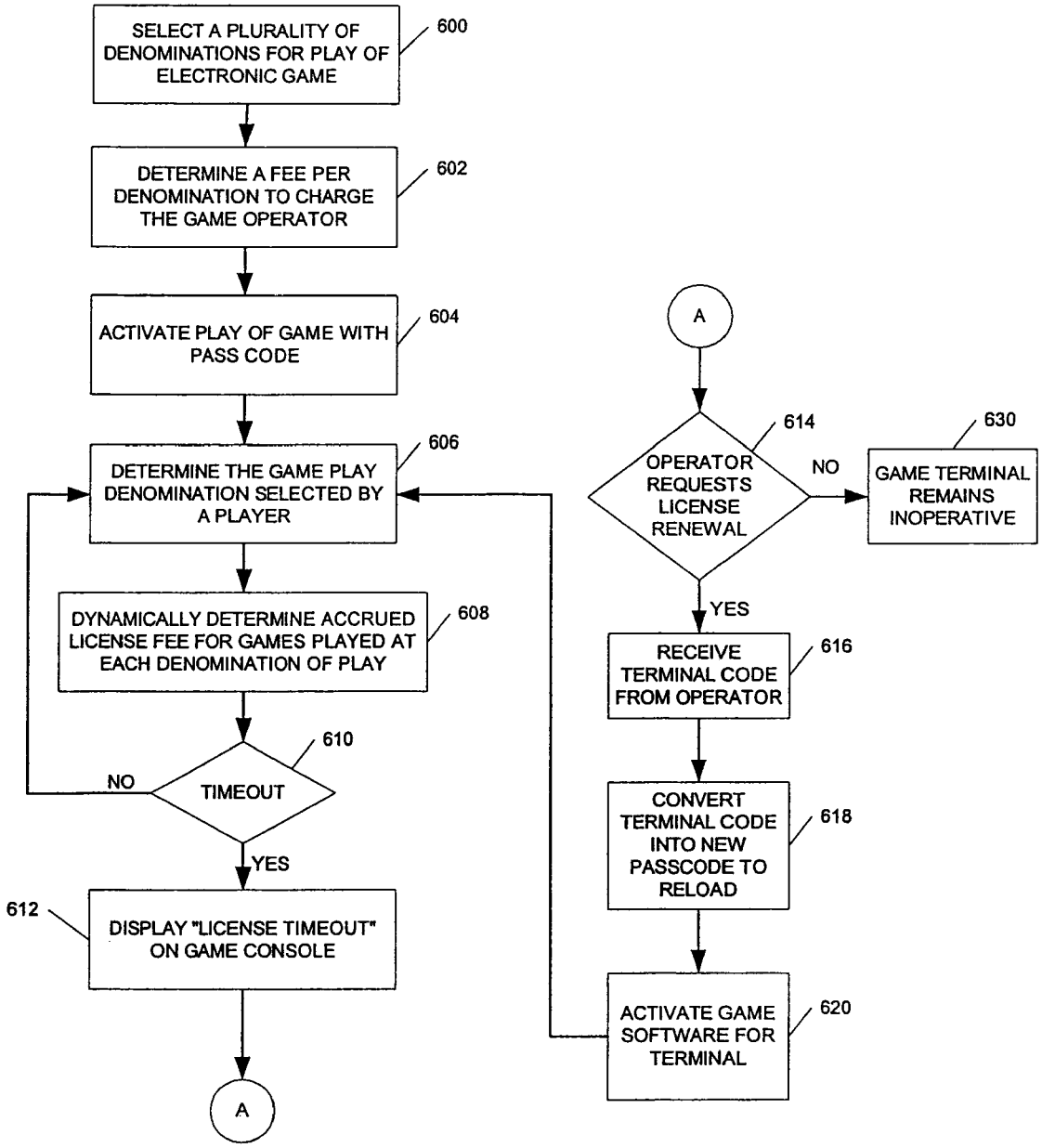
FIG. 6 illustrates the processing logic for determining the fees accrued by a game operator for plays of an electronic game in which the software license expires at the end of a predetermined time period.

FIG. 6 illustrates the processing logic for determining the fees accrued by a game operator for plays of an electronic game in which the software license expires at the end of a predetermined time period, such as 30 days or 60 days. This algorithm is particularly applicable to Class II games on Indian land. As indicated in logic block 600, the electronic game service provider selects a plurality of denominations for play of an electronic game. The denominations for an electronic game terminal can be preset by the electronic game service provider and changed by the operator. The electronic game service provider determines a fee per denomination of play to charge the game operator for each play as indicated in logic block 602. The electronic game service provider provides a passcode that is generated from the terminal identifier to the operator. The operator then enters the passcode to activate game play as indicated in block 604. The electronic game software determines the denomination of play selected by the player in block 606. After each play of the game, the game software dynamically determines the accrued license fee for the games played at each denomination of play as indicated in block 608.

After determining the accrued license fee for the games played at each denomination, the game software determines if the software license period has expired as indicated in decision block 610. If the software license has not expired, the software returns to process block 606 for the next play of the game. If the software license period has expired, the electronic game displays a "license timeout" message on the electronic game display as indicated in block 612. Next, in decision block 614, a determination is made as to whether the operator has requested a new software license period. Unless the operator requests a new software license period, the electronic game terminal remains inoperative as indicated in block 630. The operator requests a new software license period by sending the terminal identifier to the electronic game service provider in order to obtain a new passcode to reactivate the electronic game. The processing logic then returns to block 606 to wait for the next play of the electronic game.

Upon receiving the operator request for a new software license period (block 616), the electronic game service provider generates a new passcode for reactivating the electronic game terminal that is based on the terminal identifier as indicated in block 618. The electronic game terminal is reactivated for play by entering the passcode into the terminal as indicated in block 620.

Figure 7:
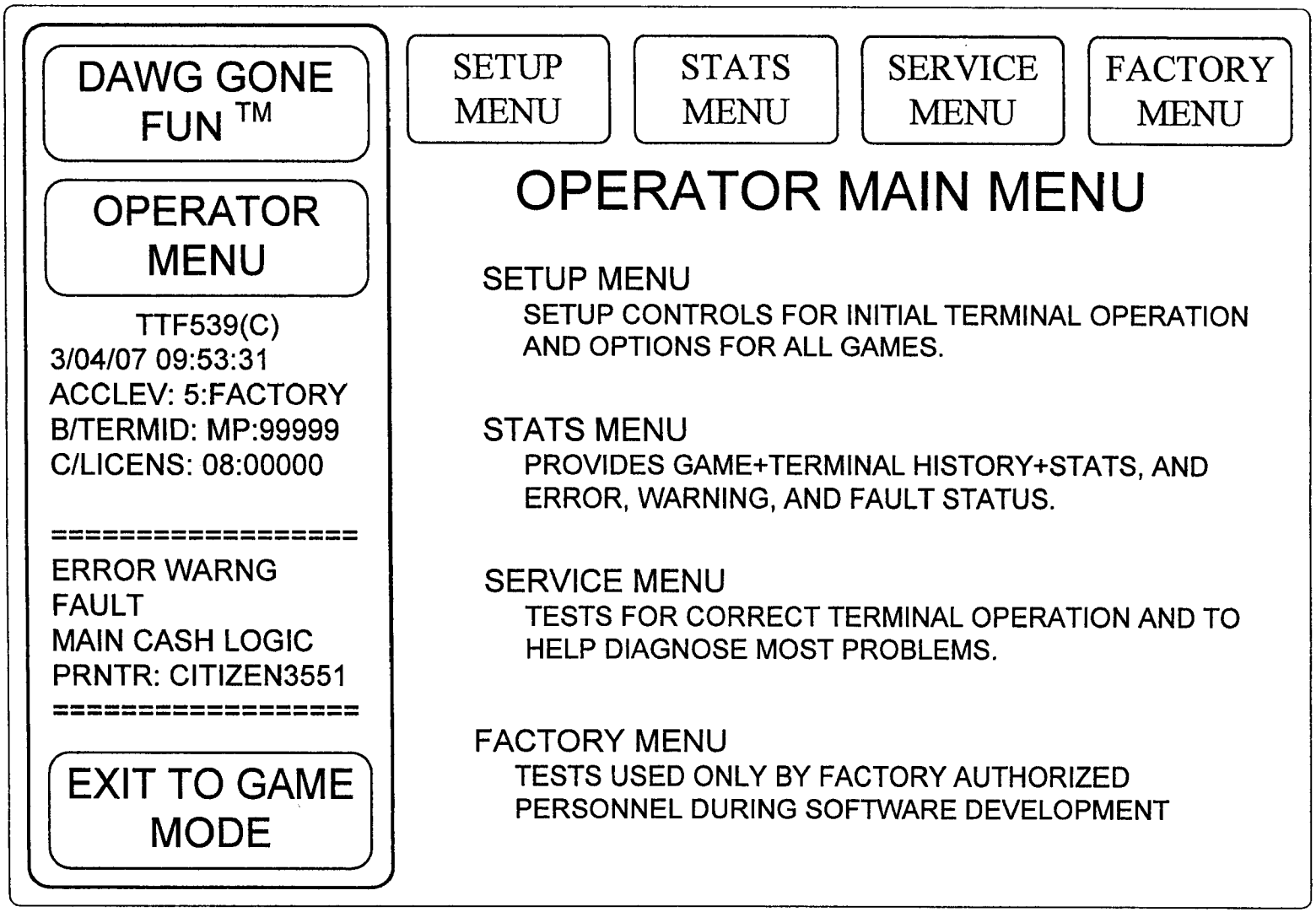
FIG. 7 illustrates an operator main menu that enables the operator to view game terminal screens that display setup controls, electronic game statistics and other game terminal information in an exemplary embodiment.

FIG. 7 illustrates an operator main menu that enables the operator to view submenus that display setup controls, electronic game statistics and other game terminal information in an exemplary embodiment. Buttons at the top of the operator main menu display enable the operator to select a setup menu, a "stats" menu and a service menu. The purpose of each operator-selectable menu is provided on the display.

Figure 8:
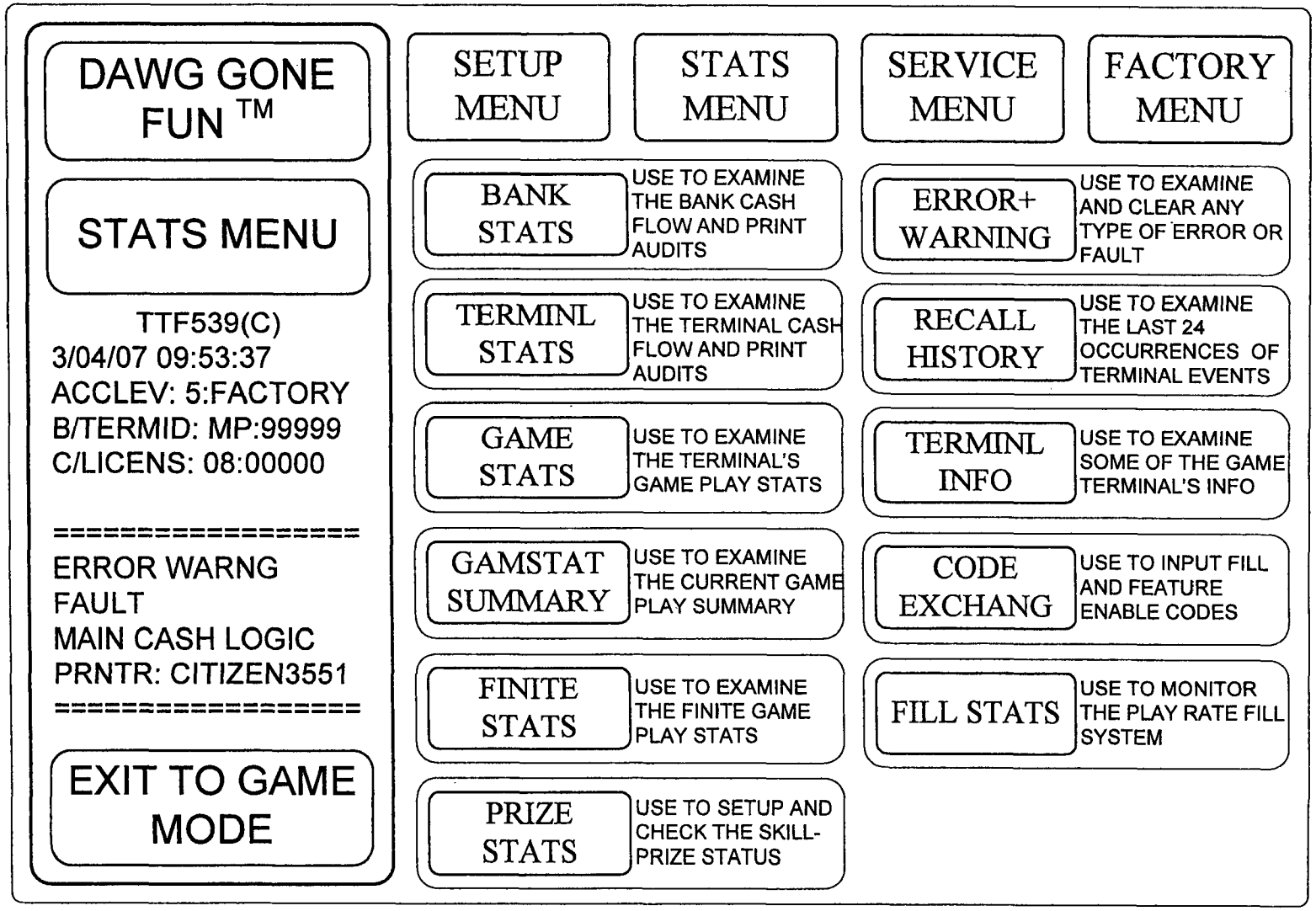
FIG. 8 illustrates a statistics menu display useful in displaying various statistics-related game terminal screens and entering a code exchange for inputting fill and feature codes for a game terminal in an exemplary embodiment.

FIG. 8 illustrates a statistics ("stats") menu display useful in displaying various statistics-related game terminal screens and a code exchange display for inputting fill and feature passcodes for a game terminal in an exemplary embodiment. An explanation of each selectable submenu is provided on the display. Buttons next to each explanation are selectable on the touch screen. Examples of the code exchange, finite stats, fill stats and prize stats displays are provided in FIGS. 9-12.

Figure 9:
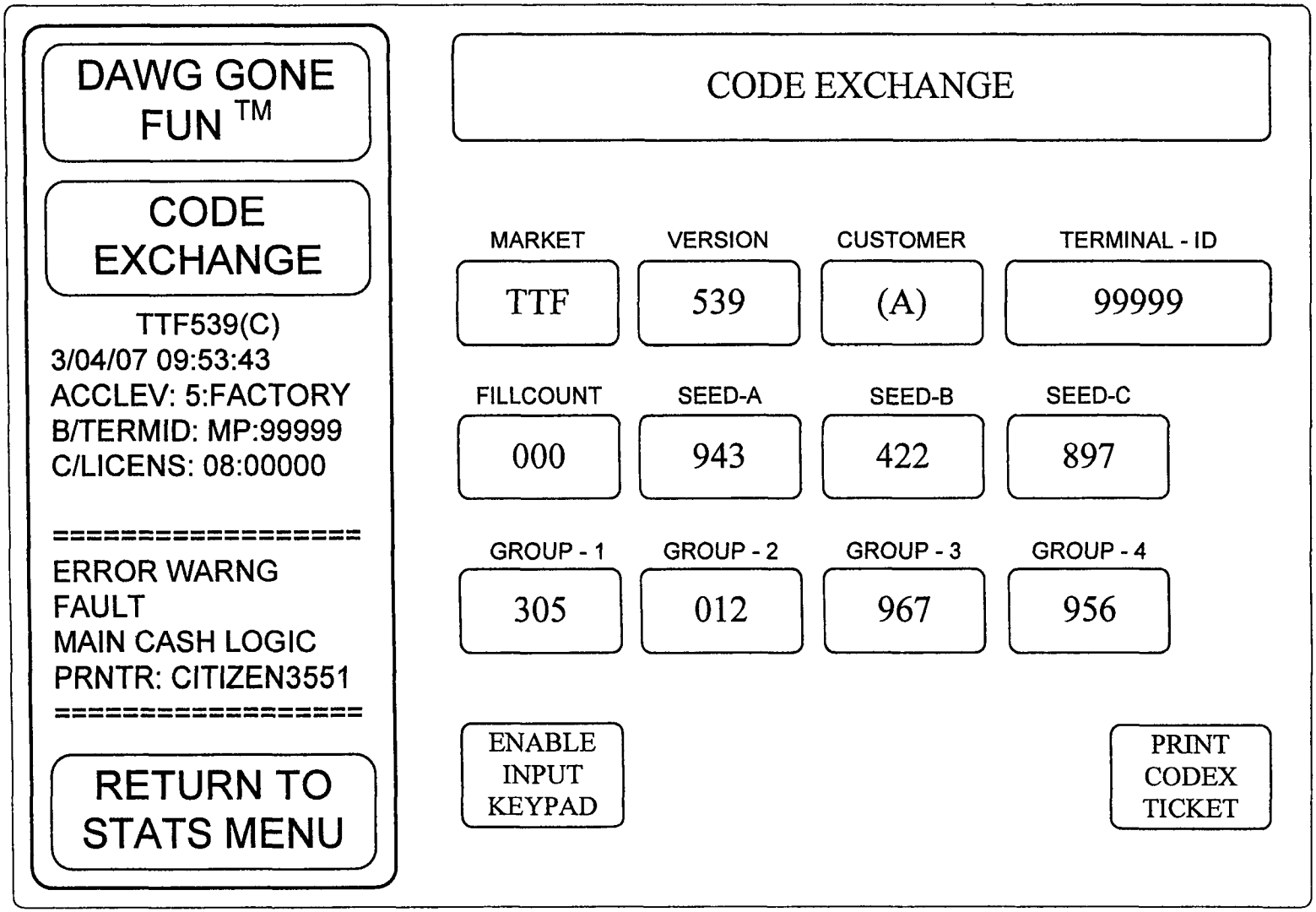
FIG. 9 illustrates a code exchange display for enabling an operator to enter a new passcode to refill game plays for a virtual game cartridge in an exemplary embodiment.

FIG. 9 illustrates a code exchange display for enabling an operator to enter a new passcode to refill game plays for a virtual game cartridge in an exemplary embodiment. The operator provides the data in the first two rows of the main window on the display to the electronic game service provider. The electronic game service provider inputs this data into an algorithm which generates a 12 digit passcode in an exemplary embodiment. The specific length of the passcode is by way of example and not limitation. The information from the operator includes a game type code, a version number of the game, a customer identification and a terminal identifier as shown in the first row of the display. The operator also provides the fill count and three groups of seeds, each seed having three numbers. The seed numbers are static, in an exemplary embodiment, and are generated by a random number generator when the game terminal is first booted. The information in the first two rows can be provided over an Internet connection or by telephone. The transmission over the Internet can be in the form of an electronic mail message or a web-based (i.e., HTML) fillable form. The numbers are split into three groups to facilitate transmission or other communication of the numbers to the electronic game service provider. The algorithm that receives the terminal information then generates a 12 digit passcode that is split into four groups of three numbers, seemingly random, that are provided to the operator over an Internet connection or other communication means (e.g., telephone, facsimile) for the operator to enter to reactivate (i.e., refill) the electronic game terminal. The passcode generated not only enables refill of the virtual cartridges, but can also be used to change configuration of game features, such as changing payouts for winning, or turning bonus features on or off. The appearance of apparently random numbers is one security aspect of the invention to prevent the operator or other people from manipulating or otherwise altering or disabling the electronic game software.

FIG. 10 illustrates a finite statistics display useful in examining game play statistics by an operator in an exemplary embodiment. The upper portion of the display in the main window shows line cycle information; the lower portion shows tier cycle information.

FIG. 11 illustrates a play rate fill system statistics display useful to monitor the play rate fill system by an operator in an exemplary embodiment. The upper portion of the main window shows summary information on the game terminal fills including fill count, date and time of first fill, and date and time of last fill.

Figure 12:
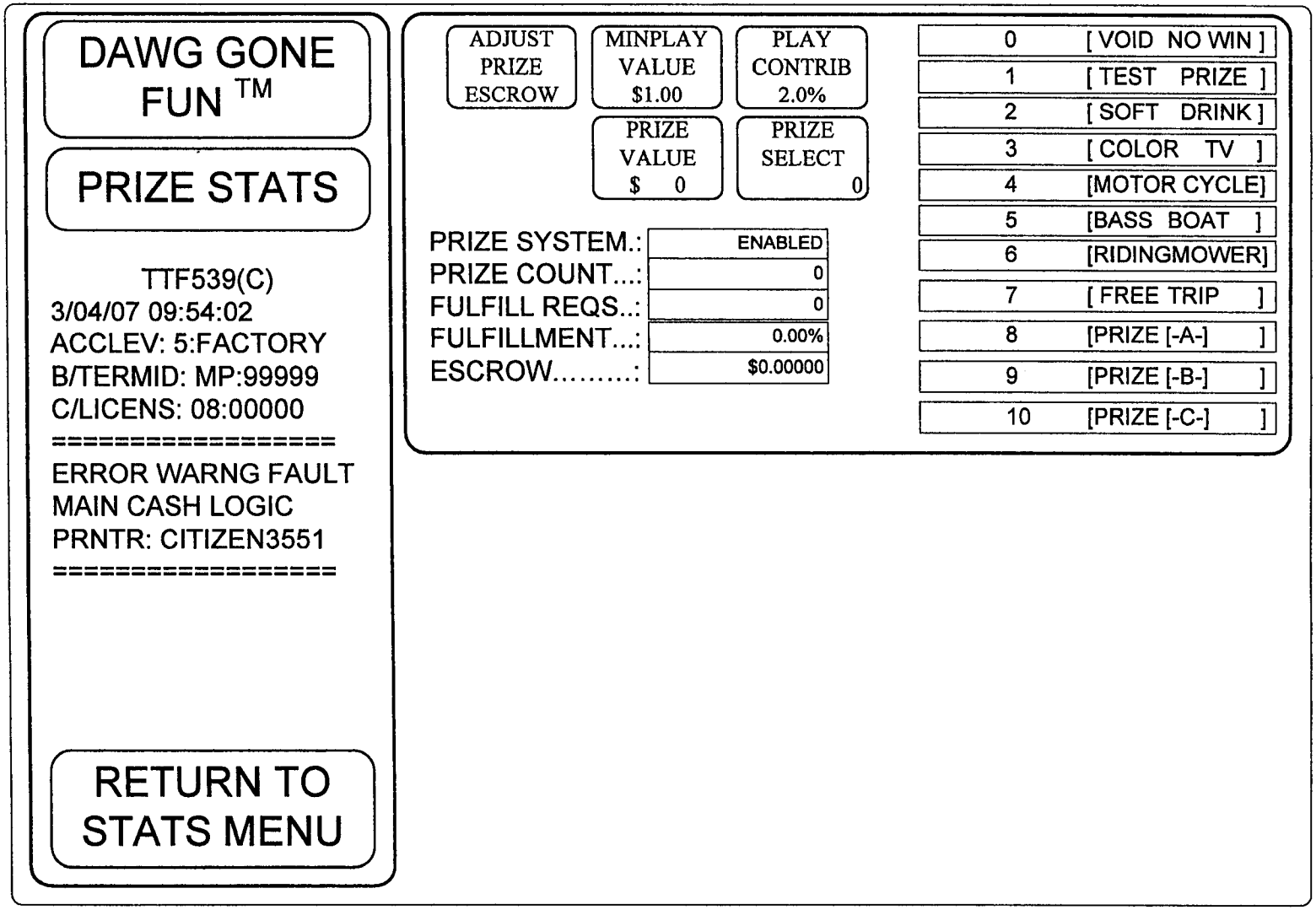
FIG. 12 illustrates a prize statistics display useful to setup and check the skill prize status by an operator in an exemplary embodiment.

FIG. 12 illustrates a prize statistics display useful to setup and check the skill prize status by an operator in an exemplary embodiment. An electronic game can have prizes associated with winning outcomes of the game in addition to, or instead of monetary awards. The selectable buttons shown in the main window of the display can be used by the operator to determine parameters for when a prize will be awarded and which prize will be awarded. These parameters include a minimum play value and a play contribution rate. The play value for each play above the minimum value of play and the contribution rate per play determine an amount that is contributed to an escrow. When a sufficient amount has been contributed to escrow, the current game player becomes eligible to win one of the associated prizes. In an exemplary embodiment, the prize system is an optional feature that can be activated by the digital code provided by the electronic game service provider.

Figure 13:
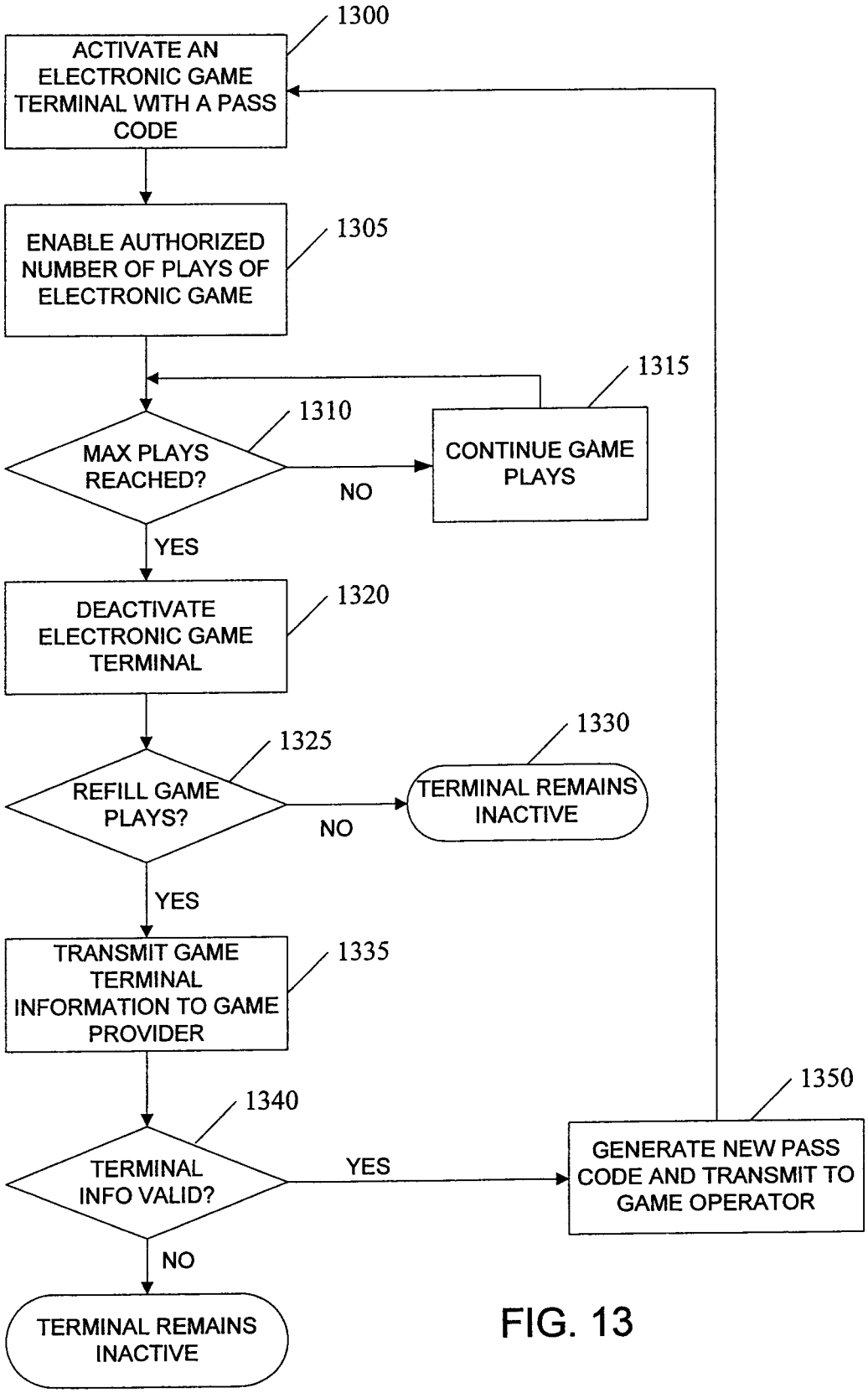
FIG. 13 illustrates processing logic for activating an electronic game terminal with a passcode unique to the specific electronic game terminal in an exemplary embodiment.

FIG. 13 illustrates processing logic for activating an electronic game terminal with a passcode unique to the specific electronic game terminal in an exemplary embodiment. The process begins in block 1300 with an electronic game terminal being activated by entry of a passcode unique to the specific game terminal. The passcode can be used not only to "refill" a virtual game cartridge, but can also be used to enable or disable one or more game features. For example, the passcode can be used to enable non-monetary prizes to be awarded as a game option, if requested by the game operator. As part of the activation process, a random number generator determines a static "seed" number that will securely identify the specific terminal when requests for game refills are made by the electronic game operator. As indicated in block 1305, an authorized number of plays of the electronic game are enabled upon successful activation of the terminal with the passcode. In decision block 1310, a determination is made as to whether or not the maximum number of plays has been reached. This test is performed automatically after each play of the electronic game. The total number of plays allowed can be based on either a fixed pre-set number of electronic game plays per virtual cartridge, or can vary as a function of the play level of individual game plays as discussed herein.

Game play continues in block 1315 until the maximum number of games has been played. Once the maximum number of game plays has occurred, the electronic game terminal is deactivated as indicated in block 1320. In decision block 1325, a determination is made regarding a request for additional game plays from the operator. Steps 1320 and 1325 ensure that the operator will only be able to reach the maximum number of plays before the terminal is deactivated. This enables the electronic game service provider to receive the appropriate electronic game terminal fees periodically to limit potential operator abuse. If the operator does not request game virtual cartridge refill, the electronic game terminal will remain deactivated as indicated in block 1345.

If the operator does request a refill, game terminal information is provided to the electronic game service provider as indicated in block 1335. This includes the terminal identifier and the static code that was generated at the first activation of the game terminal. In decision block 1340, a determination is made whether or not the terminal information provided by the operator is valid. If is not valid, the terminal will remain deactivated. If the terminal information is valid in decision block 1340, then a new passcode can be generated and transmitted to the game operator as indicated in block 1350. Processing then would return to block 1300 in which the electronic game terminal is reactivated with the new passcode.

The present invention for controlling operation and configuration of an electronic game has been described as a combination of hardware and software components. It is important to note, however, that those skilled in the art will appreciate that the software of the present invention is capable of being distributed as a program product in a variety of forms, and that the present invention applies regardless of the particular type of signal bearing media utilized to carry out the distribution. Examples of signal bearing media include, without limitation, recordable-type media such as diskettes or CD ROMs, and transmission type media such as analog or digital communications links.

The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiment are possible without departing from the spirit and scope of the present invention. In addition, it is possible to use some of the features of the present invention without the corresponding use of the other features. Accordingly, the foregoing description of the exemplary embodiment is provided for the purpose of illustrating the principles of the present invention and not in limitation thereof since the scope of the present invention is defined solely by the appended claims.

What is claimed is:

1. A method for controlling the operation and configuration of an electronic game terminal comprising a processor programmed to control play of at least one electronic game on the electronic game terminal, comprising the steps of:

enabling a game operator to select a series of play levels that can be selected by a user for play of the at least one electronic game on the electronic game terminal, wherein the at least one electronic game comprises a plurality of play levels that can be selected by a player;

constructing a field having a plurality of elements for a game display by an electronic game processor wherein each element is filled by a game symbol from a plurality of available game symbols wherein the game symbols for each element are automatically determined for each play of the game such that there is no winning combination without player interaction, wherein constructing the field includes:

selecting a number of winning combinations for a play of the game;

selecting an orientation of each winning combination for the play of the game;

selecting the symbols for each of the winning combinations; and selecting symbols for the remaining elements of the field;

presenting the field of game symbols to a player by the electronic game processor for selection of a field element wherein such player selection on the game display turns the symbol displayed in the field element into a wild symbol;

receiving the player's selection of the field element as a location for the wild symbol by the electronic game processor and determining each winning combination of symbols that is formed by such selection;

setting a license fee for a game fill for enabling play of the at least one electronic game on the electronic terminal, wherein the license fee of the game fill is based upon an amount of revenue generated by play of the at least one electronic game on the electronic game terminal;

generating a passcode for activating play of the at least one electronic game on the electronic game terminal;

communicating the passcode from an electronic game service provider computer to the game operator for input into the electronic game terminal to activate the at least one electronic game on the electronic game terminal; and generating a statistics display accessible by the game operator and displaying statistics for the plays of the at least one electronic game, including a game play statistics display showing game plays at each play level, a play rate fill statistics display showing plays remaining for a current game fill, or a prize statistics display showing status of prizes won during play of the at least one electronic game.

2. The method of claim 1, further comprising:

determining a maximum number of plays of the at least one electronic game that can be played on the electronic game terminal at each of the plurality of play levels of the at least one electronic game for the game fill.

3. The method of claim 1, further comprising:

dynamically determining a number of games remaining on the electronic game terminal for the game fill following each play of the at least one electronic game using the processor of the electronic game terminal, wherein the number of games remaining varies based on a number of games previously played at each level of play of the plurality of levels of play of the at least one electronic game; and automatically disabling play of the at least one electronic game on the electronic game terminal, if the processor of the electronic game terminal determines that there are no electronic games of the game fill remaining to be played.

4. The method of claim 3, further comprising:

receiving a request for a new passcode from the game operator to refill the electronic game plays on the electronic game terminal, the request being received by the electronic game service provider computer and including a unique electronic game terminal identifier;

in response to the request, generating a new passcode using the electronic game service provider computer, the new passcode based, at least in part, on the unique electronic game terminal identifier, for reactivating game plays of the at least one electronic game on the electronic game terminal; and communicating the new passcode to the game operator for input into the electronic game terminal.

5. The method of claim 3, wherein dynamically determining the number of games remaining comprises weighting the number of plays that have been previously selected by at least one player at each level of play.

6. The method of claim 4, wherein sending the request for the new passcode further comprises generating a code created by the electronic game terminal upon an initial activation of plays on the electronic game terminal, and wherein the unique electronic game terminal identifier is entered into a passcode-generating algorithm operating on the electronic game service provider computer.

7. A method for controlling the operation and configuration of an electronic game terminal comprising a processor programmed to control play of at least one electronic game on the electronic game terminal, comprising the steps of:

enabling a game operator to select a series of play levels that can be selected by a user for play of the at least one electronic game on the electronic game terminal, wherein the at least one electronic game comprises a plurality of play levels that can be selected by a player;

constructing a field having a plurality of elements for a game display by an electronic game processor wherein each element is filled by a game symbol from a plurality of available game symbols wherein the game symbols for each element are automatically determined for each play of the game such that there is no winning combination without player interaction, wherein constructing the field includes:

selecting a number of winning combinations for a play of the game;

selecting an orientation of each winning combination for the play of the game;

selecting the symbols for each of the winning combinations; and selecting symbols for the remaining elements of the field;

presenting the field of game symbols to a player by the electronic game processor for selection of a field element wherein such player selection on the game display turns the symbol displayed in the field element into a wild symbol;

receiving the player's selection of the field element as a location for the wild symbol by the electronic game processor and determining each winning combination of symbols that is formed by such selection;

generating a statistics display accessible by the game operator and displaying statistics for the plays of the at least one electronic game, including a game play statistics display showing game plays at each play level, a play rate fill statistics display showing plays remaining for a current game fill, or a prize statistics display showing status of prizes won during play of the at least one electronic game; and testing the field to ensure that a winning combination more valuable than the selected winning combinations is not generated inadvertently in completing the field.

8. A method for controlling the operation and configuration of an electronic game terminal comprising a processor programmed to control play of at least one electronic game on the electronic game terminal, comprising the steps of:

enabling a game operator to select a series of play levels that can be selected by a user for play of the at least one electronic game on the electronic game terminal, wherein the at least one electronic game comprises a plurality of play levels that can be selected by a player;

constructing a field having a plurality of elements for a game display by an electronic game processor wherein each element is filled by a game symbol from a plurality of available game symbols wherein the game symbols for each element are automatically determined for each play of the game such that there is no winning combination without player interaction, wherein constructing the field includes:

selecting a number of winning combinations for a play of the game;

selecting an orientation of each winning combination for the play of the game;

selecting the symbols for each of the winning combinations; and selecting symbols for the remaining elements of the field;

presenting the field of game symbols to a player by the electronic game processor for selection of a field element wherein such player selection on the game display turns the symbol displayed in the field element into a wild symbol;

receiving the player's selection of the field element as a location for the wild symbol by the electronic game processor and determining each winning combination of symbols that is formed by such selection;

generating a statistics display accessible by the game operator and displaying statistics for the plays of the at least one electronic game, including a game play statistics display showing game plays at each play level, a play rate fill statistics display showing plays remaining for a current game fill, or a prize statistics display showing status of prizes won during play of the at least one electronic game; and setting one or more skill prizes associated with game outcomes, and setting parameters for when a selected skill prize is awarded using the prize statistics display.

9. The method of claim 8, wherein the skill prizes comprise non-monetary awards.

10. The method of claim 8, wherein at least one parameter comprises a contribution percentage of each level of play to add to a prize award escrow account, and wherein when a selected amount has been contributed to the escrow by a player, the player is eligible to win a skill prize associated with the escrow amount.

* * * * *